US006027127A

United States Patent [19]

Olson et al.

[11] Patent Number: 6,027,127

[45] Date of Patent: Feb. 22, 2000

[54] OFF-ROAD IN-LINE SKATE

[75] Inventors: Todd J. Olson, Chanhassen; Lloyd G. Keleny, Champlin, both of Minn.

[73] Assignee: Rollerblade, Inc., Minnetonka, Minn.

[21] Appl. No.: 08/800,092

[22] Filed: Feb. 12, 1997

[51] Int. Cl.[7] ..... A63C 17/02

[52] U.S. Cl. ..... 280/11.22

[58] Field of Search ..... 280/11.22, 11.23, 280/11.3; 301/5.3, 5.7

[56] References Cited

U.S. PATENT DOCUMENTS

| | | |
|---|---|---|
| D. 326,700 | 6/1992 | Brown et al. . |
| D. 354,538 | 1/1995 | Skerbinjek . |
| 833,100 | 10/1906 | Wells . |
| 920,848 | 5/1909 | Eubank, Jr. . |
| 1,497,224 | 6/1924 | Ormiston . |
| 2,168,820 | 8/1939 | Edstrom . |
| 2,559,118 | 7/1951 | Foran . |
| 3,877,710 | 4/1975 | Nyitrai . |
| 3,885,804 | 5/1975 | Cudmore . |
| 4,394,028 | 7/1983 | Wheelwright . |
| 4,418,929 | 12/1983 | Gray . |
| 4,709,937 | 12/1987 | Lin et al. . |
| 4,711,458 | 12/1987 | Shim . |
| 4,943,075 | 7/1990 | Gates . |
| 5,251,934 | 10/1993 | Gates . |
| 5,286,043 | 2/1994 | Tkaczyk . |
| 5,346,231 | 9/1994 | Ho . |
| 5,388,846 | 2/1995 | Gierveld ..... 280/11.22 |
| 5,398,950 | 3/1995 | Tkaczyk . |
| 5,411,277 | 5/1995 | Pratt ..... 280/11.22 |
| 5,630,891 | 5/1997 | Peterson et al. ..... 301/5.3 X |
| 5,704,617 | 1/1998 | Stoughton et al. ..... 280/11.22 X |

FOREIGN PATENT DOCUMENTS

| | | |
|---|---|---|
| 0 607 817 A2 | 7/1995 | European Pat. Off. . |
| 0 799 692 A1 | 10/1997 | European Pat. Off. . |
| 12596 | 6/1896 | Germany ..... 280/11.23 |
| 1339 | of 1893 | United Kingdom ..... 280/11.23 |
| 17066 | of 1893 | United Kingdom ..... 280/11.23 |
| WO 96/01139 | 1/1996 | WIPO . |
| 037 602 | 11/1996 | WIPO . |
| 042 151 | 1/1998 | WIPO . |

OTHER PUBLICATIONS

"Off–Road Big Cat" and "Off–Road Enduro", p. 42, 1997 Inline Retailer & Industry News Buyer's Guide.

Photographs of an Elpex Off–Road Rollerski, 1 page.

*Primary Examiner*—Robert J. Oberleitner
*Assistant Examiner*—Daniel Yeagley
*Attorney, Agent, or Firm*—Merchant & Gould P.C.

[57] ABSTRACT

An off-road in-line skate which includes a plurality of wheels mounted to a frame of a skate where the wheels each have a diameter in the range of 40 to 60% of the length of a boot of the skate to provide a maximum wheel diameter to clear obstructions while presenting an overall wheel base length less than a maximum wheel base length which would otherwise cause tripping during cross-over skating.

10 Claims, 4 Drawing Sheets

OFF-ROAD IN-LINE SKATE

I. BACKGROUND OF THE INVENTION

1. Field of the Invention

This invention pertains to in-line roller skates. More particularly, this invention pertains to in-line roller skates adapted for use on rough terrain.

2. Description of the Prior Art

In-line skating has become immensely popular. In-line skates are distinguished from traditional quad skates by having wheels mounted in a common plane and with the axles of the wheels in parallel, spaced-apart alignment.

In-line skates provide a skating motion which simulates ice-skating. In-line skates have been extremely popular for use on smooth, hard surfaces such as pavement, asphalt or the like, for recreational skating and sports skating (such as in-line hockey).

In-line skates are not comfortable for use for skating on surfaces other than paved surfaces. For example, such skates are not practical for skating on rough terrain or on grassy surfaces.

Certain designs have been suggested for use on surfaces other than hard surfaces. For example, U.S. Pat. No. 5,411,277 to Pratt, dated May 2, 1995, purports to teach a multi-terrain in-line skate chassis for use on wet surfaces. U.S. Pat. No. 5,346,231 to Ho, dated Sep. 13, 1994, teaches an in-line skate with an inflatable rubber tire for shock absorbency.

II. SUMMARY OF THE INVENTION

According to a preferred embodiment of the present invention, an in-line skate is disclosed having a boot for receiving a skater's foot. The boot extends from a heel to a toe. A frame is secured to the boot with a plurality of wheels mounted on the frame for rotation about individual axes of rotation and with the wheels mounted in a line. The wheels are completely disposed beneath a plane of the sole of the boot. A sum of the diameter of the wheels and a spacing between the wheels is less than a maximum wheel base length which is selected to avoid interference between skates of a user during cross-over skating. The diameter is selected to be a maximum diameter for the sum of the diameters to fit within the maximum wheel base length and with adjacent wheels in close proximity, with at least one of the wheels having an axis disposed beneath the sole and between the heel and the toe.

III. BRIEF DESCRIPTION OF THE DRAWINGS

IV. PREFERRED EMBODIMENT

Figure 5:
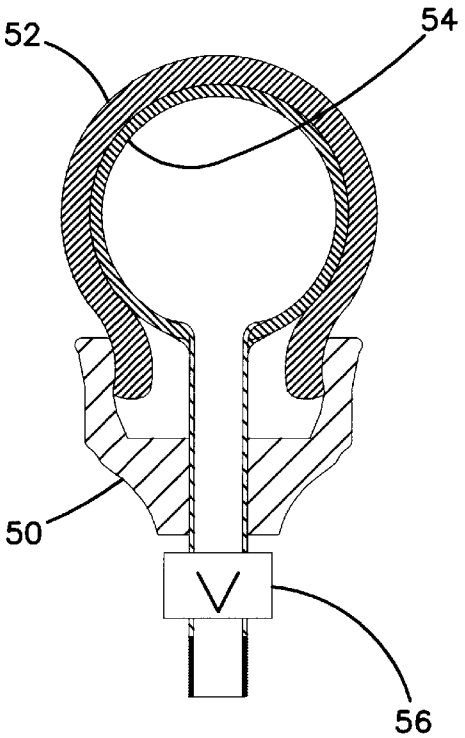
FIG. 5 is a partial sectional view of a wheel for use in the skate of FIG. 1.
Figure 1:
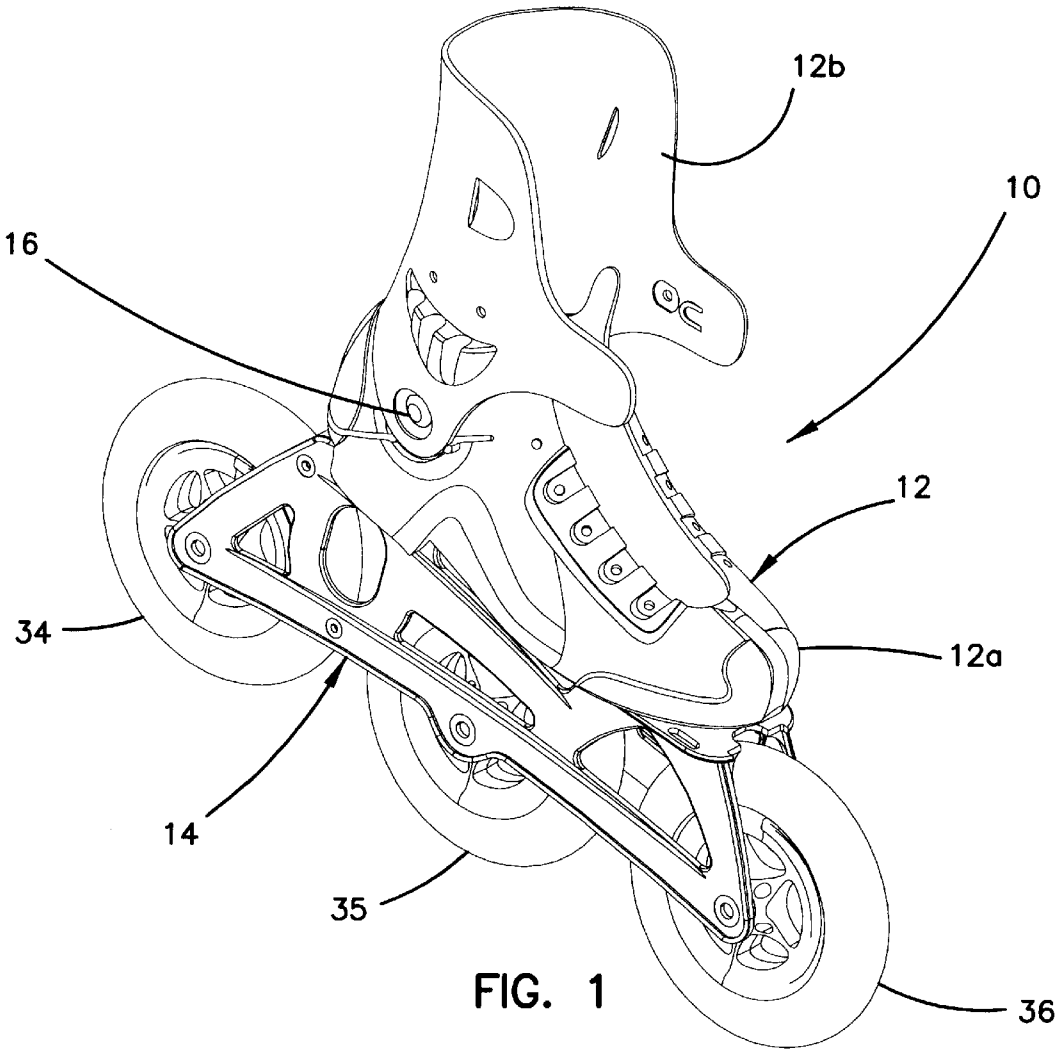
FIG. 1 is a front, top and right side perspective view of a skate according to the present invention.

Referring now to the several drawing figures in which identical elements are numbered identically throughout, a description of a preferred embodiment of the present invention will now be provided.

The present invention is an in-line skate 10 for use in skating on rough terrain and grassy surfaces.

Normally, in-line skates are provided with polyurethane wheels having a diameter of about 2 to 3¼ inches (50 to 80 mm). Such wheels make for excellent skating on hardened surfaces such as asphalt and pavement. Unfortunately, such wheels are not suitable for use on rough terrain (such as gravel surfaces or surfaces with ruts) or grassy areas. The polyurethane wheels typically have a diameter of about 3 to 4 inches, which greatly restricts the size of the obstruction which can be cleared by the wheels. Further, the polyurethane absorbs and transmits vibrations from the roughened surface to the skater making for an uncomfortable skating experience.

As will be more fully described, the present invention utilizes greatly enlarged wheels which enable a skater to clear substantially larger obstructions, as well as traversing substantially larger ruts that would be otherwise possible with traditional in-line skate wheels. Further, the present invention utilizes pneumatic tires in order to reduce vibrations.

Enlarging tires necessitates enlarging the wheel base length of an in-line skate, since the wheel base length will be the sum of the diameters of all tires on the skate plus the clearance distance between adjacent wheels. Unfortunately, as the wheel base length of an in-line skate increases, the skate becomes impractical to use. Namely, from time to time, a skater engages in what is referred to as a "cross-over" stride, where a skater will cross one foot over and in front of the other foot during skating. For example, during turning, a skater may lift a right foot and pass the right foot over and in front of the left foot. As the skate length increases, the rear wheel of the crossing over skate (the right foot) may hit the front wheel of the crossed over skate (the left skate). This can result in tripping the skater. While skaters' strides may vary from person to person, for most individuals, the maximum wheel base length to avoid interference during a cross-over is about 17 to 22 inches, and preferably about 19.5 inches. The present invention utilizes this constraint on the wheel base length in order to maximum performance of an off-road skate. The wheel base length is the sum of the diameters of a wheels of the skate plus the sum of the distances between adjacent wheels.

As shown in the figures, the skate 10 includes a boot 12 mounted on a frame 14. The boot 12 includes a lower 12*a* and a cuff 12*b*. The cuff 12*b* is pivotally hinged to the lower 12*a* at a pivot point 16. The pivot point 16 is in general alignment with the ankle of the user. The lower 12*a* is sized to receive the user's foot and includes a sole 18 extending from a heel 20 to a toe 22. The distance between the heel 20 and the toe 22 is the boot length while a conventional liner is used with the boot, it is not shown in the figures for purposes of clarity of the illustration. Also, in the drawings, lacings and other fasteners (i.e., buckles) are not shown.

Figure 2:
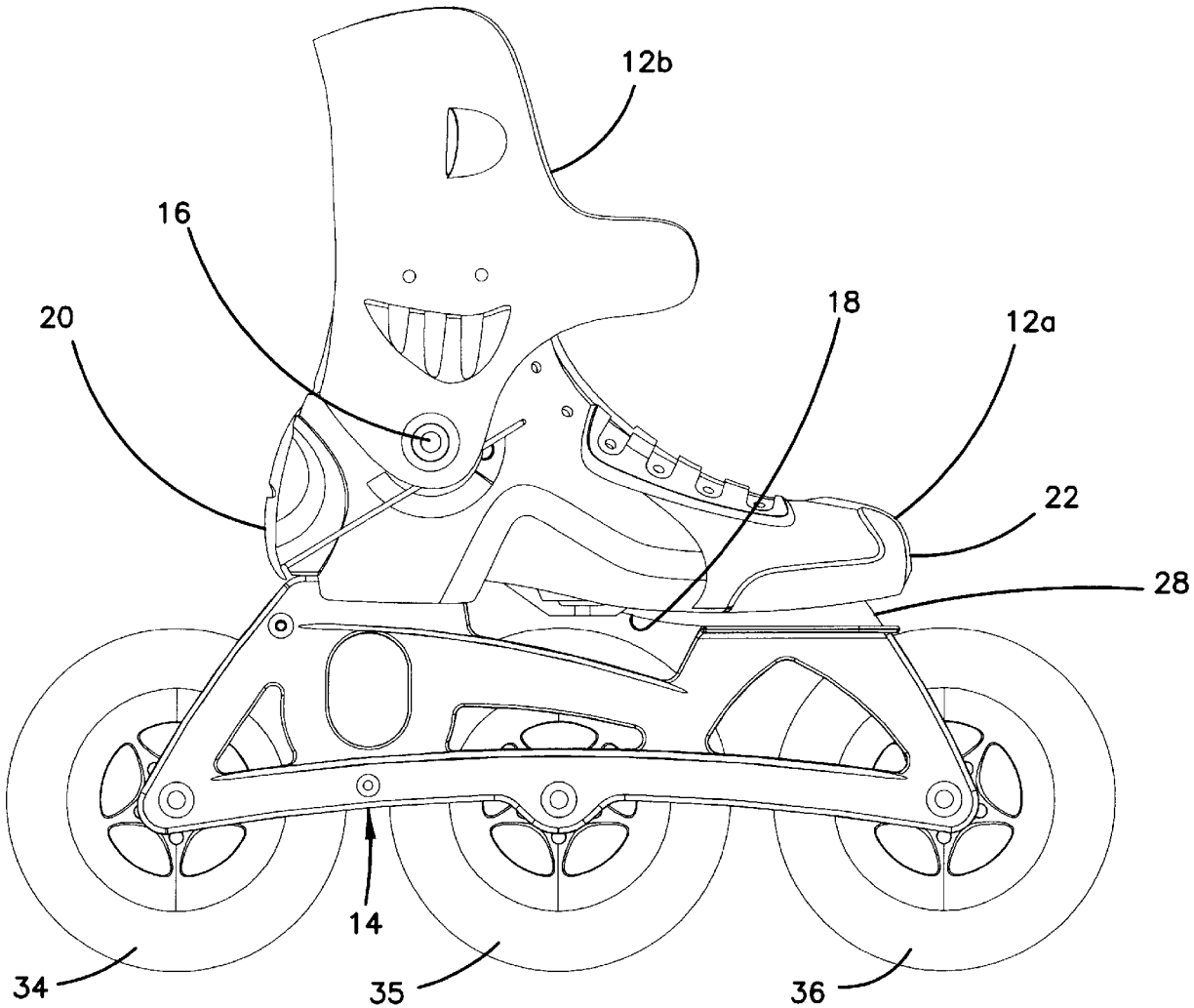
FIG. 2 is a side elevation view of a skate of FIG. 1.
Figure 3:
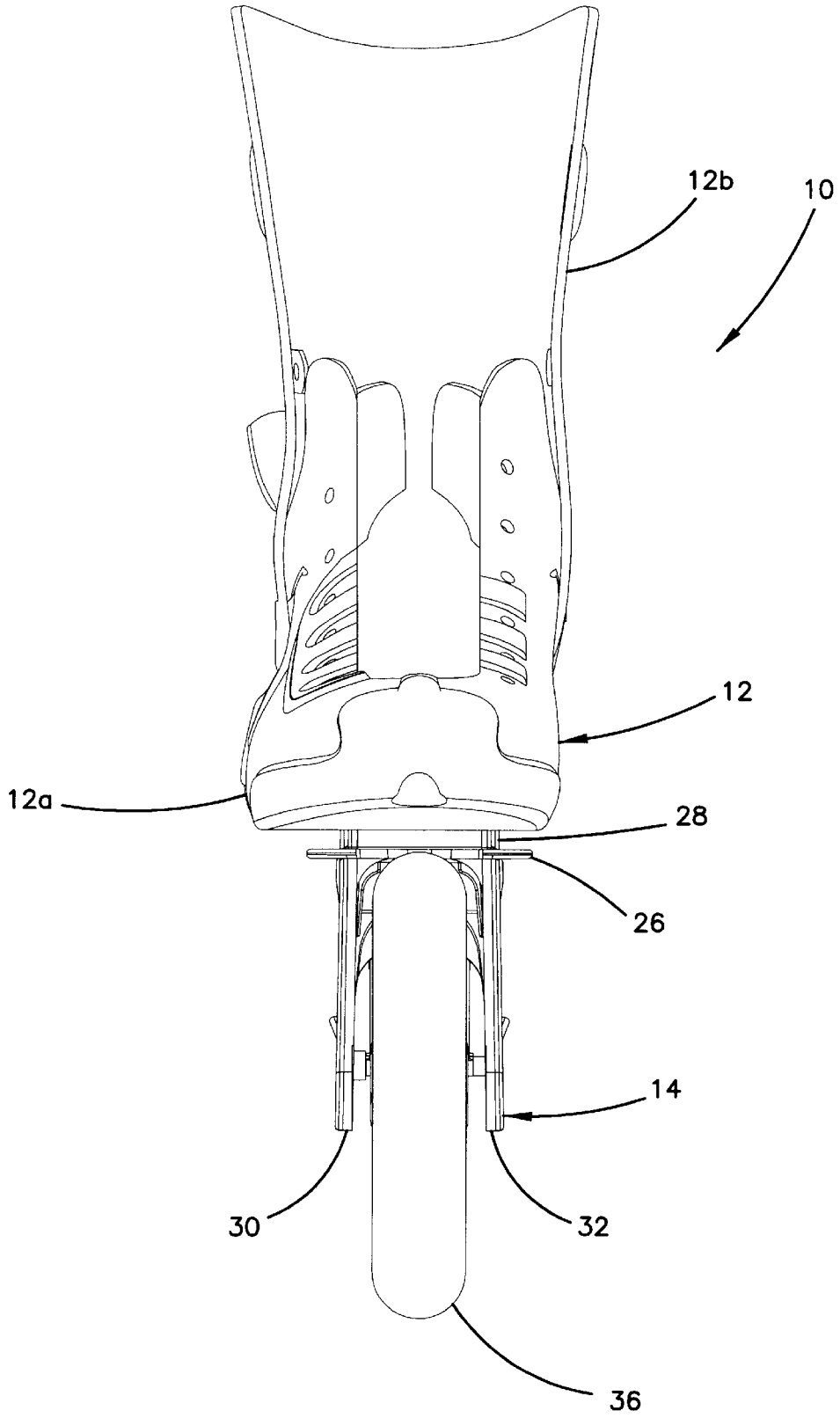
FIG. 3 is a front elevation view of the skate of FIG. 1.

The frame includes attachment plates 24, 26, which may be fastened to the sole 18 of the boot through any suitable means, such as bolts or the like. As shown in FIG. 2, a spacer 28 may be used between the plate 26 and the sole 18.

Figure 4:
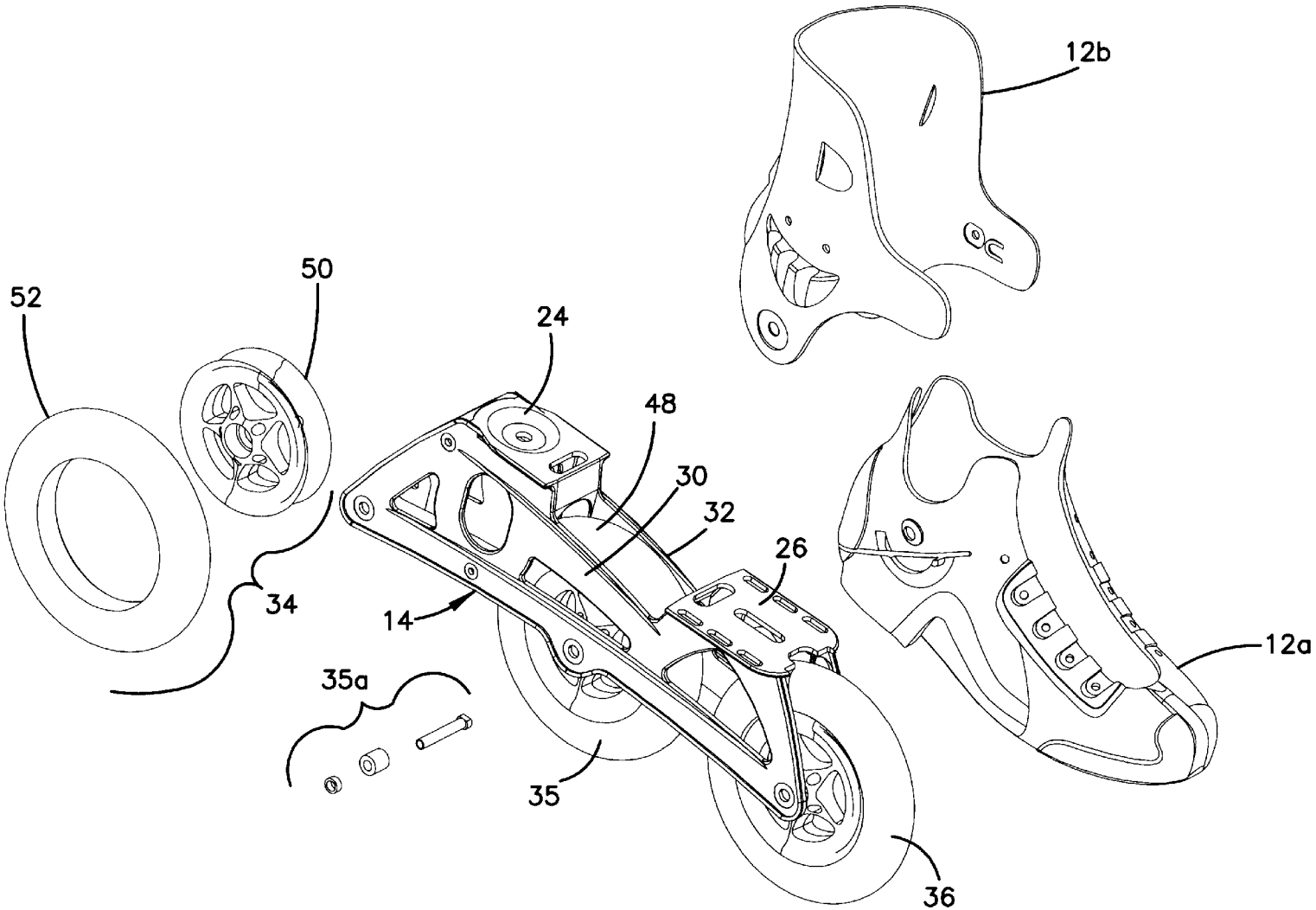
FIG. 4 is an exploded perspective view of the skate of FIG. 1.

The frame further includes sidewalls 30, 32, which are parallel and spaced apart. A plurality of wheels 34, 35 and 36 are mounted within the space between the sidewalls 30, 32. Each of the wheels 34, 35 and 36 is mounted on an individual axle and bearing (only axle 35*a* is shown in FIG. 4) with the axes in linear alignment such that each of the wheels 34, 35, 36 rotates in a common plane. As will be more fully discussed, the wheels 34, 35, 36 are about 4 to 7 inches in diameter and preferably about 6 inches in diameter.

The wheels 34, 35, 36 are mounted completely beneath the sole 18 of the boot 12. In order to keep the sole 18 of the boot 12 as low to the skating surface as possible, the frame 14 is provided with cutouts 48 and the like in order to minimize the clearance of the wheels 34, 35, 36 to the sole 18.

Each of the wheels 34, 35 and 36 is identical. The wheels include a plastic hub 50 through which the axle and bearings are passed. A pneumatically inflated rubber tire 52 is mounted on the hub 50. Preferably, the rubber tire 52 includes an inner tube 54 with a valved inflation conduit 56 for an inflating the inner tube 54 to any desired pressure, preferably between 40 and 90 psi. The pneumatically pressurized tires assist in shock absorption and vibration reduction, as well as absorbing or deforming in response to pebbles or other deformities to permit the axles of the skate 10 to move in a straight line over rough surfaces. Further, the pressure can be adjusted by the user in order to tune the rolling resistance of the skate.

Applicants have determined that an off-terrain skate should have at least one wheel 35 with an axle positioned beneath the sole and between the toe 22 and the heel 20 to assist in turning and other performance criteria. Further, the spacing between the wheels 34, 35, 36 should be minimal (i.e., about ¾ of an inch) to permit small rocks to pass through.

A large wheel is desirable to overcome obstructions. For example, a 6 inch wheel has a 3 inch radius to permit rolling over obstructions less than or equal to 3 inches.

As previously mentioned, experience with five wheel racing skates of normal wheel diameter (i.e., about 80 mm) has resulted in the identification of a maximum total length of the wheel base to avoid tripping during cross-over. Applicants have also determined that the ground to foot height of the skate should not exceed about 7 inches to maximize user comfort.

It is desirable to maximum the size of the wheels 34, 35, 36 within the constraints of the maximum length of the wheel base to avoid tripping during cross-over. It is also desirable to maintain the existence of at least one wheel 35 with an axle 35*a* positioned directly beneath the boot.

Utilizing the foregoing constraints, the maximum wheel size is between 5 and 7 inches and preferably about 6 inches in order to attain maximum wheel size necessary to clear obstructions while at the same time stay within the bounds of the maximum wheel base length and maintain at least one wheel 35 beneath the skate. This results in a total of three wheels 34, 35, 36 for an optimum performance off-road skate. With these constraints, the wheel diameter is in a range of about 40 to 60% of the length of the boot 12. For example, for a size 14 boot having a length of about 13 inches and a maximum wheel base of about 19.5 inches, the 6 inch wheels are slightly less than 50% of the boot length. For size 6 boots, having 6 inch wheels with the maximum wheel base of 19.5 inches and a boot length of 11.5 inches, 6 inch wheels represent slightly more than 50% of the booth length.

In the drawings, braking mechanisms are not shown. It will be recognized that at least one of a pair of skates will have a braking mechanism. The braking mechanism may be a caliper acting brake which acts on the hub or may be a brake which acts against the wheel itself. Such a brake may be hand actuated or may be cuff actuated. It will be appreciated that examples of such brakes are well known in the art and form no part of this invention per se. In view of the higher elevation of the skate due to enlarged wheels 34, 35, 36, the distance from the top of the cuff 12*b* to the sole of the boot 12 is about 12 inches to provide enhanced lateral support.

Having disclosed the invention in a preferred embodiment, it will be appreciated that the objects of the invention have been attained. Modifications and equivalents of the disclosed concepts which readily occur to one skilled in the art are intended to be included within the scope of the claims which are appended hereto.

What is claimed is:

1. An in-line skate comprising:

a boot for receiving a skater's foot, said boot having a sole and a boot length extending from a heel to a toe;

a frame secured to said boot;

exactly three wheels having substantially the same size diameter mounted on said frame for rotation about individual axis of rotation, including a front wheel, a center wheel and a rear wheel, with said wheels mounted in a line;

said wheels further mounted to said frame for a periphery of said wheels to be completely disposed beneath a plane of said sole with said rear wheel having an axis disposed beneath said plane of said sole and spaced rearwardly from said heel, said center wheel having an axis disposed beneath said plane of said sole and between said heel and said toe, and said front wheel having an axis disposed beneath said plane of said sole and spaced forwardly from said toe;

each of said wheels sized to have a diameter in a range of 40 to 60 percent of said boot length.

2. An in-line skate according to claim 1 wherein said wheels are mounted with peripheries of adjacent wheels in close proximity.

3. An in-line skate according to claim 1 wherein said wheels include synthetic rubber wheel portions mounted on hubs and with said wheel portions being pneumatically inflated.

4. An in-line skate according to claim 1 wherein said diameter is between 5 and 7 inches.

5. An in-line skate according to claim 1 wherein a sum of a diameter of said wheels and a spacing between said wheels is not greater than a maximum wheel base length selected to avoid interference between skates of a user during cross-over skating.

6. An in-line skate according to claim 5 wherein said maximum wheel base length is between 17 and 22 inches.

7. An in-line skate comprising:

a boot for receiving a skater's foot, said boot having a sole and a boot length extending from a heel to a toe;

a frame secured to said boot;

exactly three wheels mounted on said frame for rotation about individual axes of rotation, including a front wheel, a center wheel and a rear wheel, with said wheels mounted in a line;

said wheels further mounted to said frame for a periphery of said wheels to be completely disposed beneath a plane of said sole;

a sum of a diameter of said wheels and a spacing between said wheels being not greater than a maximum wheel base length selected to avoid interference between skates of a user during cross-over skating with said maximum wheel base length being between 17 and 22 inches;

said diameter selected to be a maximum diameter for said sum to fit within said maximum wheel base length with adjacent wheels in close proximity and with said rear wheel having an axis disposed beneath said plane of said sole and spaced rearwardly from said heel, said center wheel having an axis disposed beneath said plane of said sole and between said heel and said toe, and said front wheel having an axis disposed beneath said plane of said sole and spaced forwardly from said toe.

8. An in-line skate according to claim 7 wherein said wheels include synthetic rubber wheel portions mounted on hubs and with said wheel portions being pneumatically inflated.

9. An in-line skate according to claim 7 wherein said maximum wheel base length is about 19 to 20 inches.

10. An in-line skate according to claim 7 wherein said diameter is between 5 and 7 inches.

* * * * *

UNITED STATES PATENT AND TRADEMARK OFFICE

CERTIFICATE OF CORRECTION

PATENT NO. : 6,027,127
DATED : February 22, 2000
INVENTOR(S) : Olson et al.

It is certified that error appears in the above-identified patent and that said Letters Patent is hereby corrected as shown below:

Column 4,
Line 19, "axis" should read -- axes --
Line 55, after "wheels" insert -- having substantially the same size diameter --

Signed and Sealed this

Twenty-sixth Day of November, 2002

*Attest:*

*Attesting Officer*

JAMES E. ROGAN
*Director of the United States Patent and Trademark Office*